US007287964B2

(12) United States Patent
Sanwald

(10) Patent No.: US 7,287,964 B2
(45) Date of Patent: Oct. 30, 2007

(54) METHOD AND SYSTEM FOR PUMPING POWDER, AND POWDER COATING APPARATUS

(75) Inventor: Marco Sanwald, St. Gallen (CH)

(73) Assignee: ITW GEMA AG, St. Gallen (CH)

( * ) Notice: Subject to any disclaimer, the term of this patent is extended or adjusted under 35 U.S.C. 154(b) by 638 days.

(21) Appl. No.: 10/752,099

(22) Filed: Jan. 7, 2004

(65) Prior Publication Data

US 2006/0159565 A1 Jul. 20, 2006

(30) Foreign Application Priority Data

Jan. 8, 2003 (DE) ..... 103 00 280
Jun. 27, 2003 (EP) ..... 03014661

(51) Int. Cl.
*F04B 45/00* (2006.01)
*F04B 17/00* (2006.01)
*F04B 35/00* (2006.01)

(52) U.S. Cl. ..... 417/397; 417/395

(58) Field of Classification Search ..... 417/395, 417/397

See application file for complete search history.

(56) References Cited

U.S. PATENT DOCUMENTS 2,667,280 A * 1/1954 Lane et al. ..... 414/805
2,687,280 A 8/1954 Sharp
3,391,963 A 7/1968 Weeks
4,405,289 A * 9/1983 Nakashima ..... 417/250
5,078,084 A * 1/1992 Shutic et al. ..... 118/309
5,330,576 A * 7/1994 Clauditz ..... 118/688
5,739,429 A * 4/1998 Schmitkons et al. ..... 73/196
5,816,778 A * 10/1998 Elsey et al. ..... 417/46

FOREIGN PATENT DOCUMENTS

DE 1 087 520 8/1960
DE 39 00 718 A1 12/1992
EP 0 124 933 A 11/1984
EP 1 106 547 A1 6/2001
WO 03/024612 A1 3/2003

* cited by examiner

*Primary Examiner*—Anthony D. Stashick
*Assistant Examiner*—Patrick Hamo
(74) *Attorney, Agent, or Firm*—Lowe, Hauptman, Ham & Berner

(57) ABSTRACT

In a pump system for supplying powder, in particular coating powder, to a powder coating apparatus, time controller is used to introduce compressed gas into a metering chamber as a function of the predetermined delay time elapsed since a predetermined operational point for the purpose of expelling a quantity of powder that was introduced into the metering chamber until the end of the time delay.

26 Claims, 5 Drawing Sheets

METHOD AND SYSTEM FOR PUMPING POWDER, AND POWDER COATING APPARATUS

TECHNICAL FIELD

The present invention relates to a powder-pumping system, in particular used to pump a coating powder, as defined in the preamble of claim 1, further an associated method, and a powder-coating apparatus including at least one such pumping system.

BACKGROUND

A pumping system of this kind is known from the European patent document 0,124,933 A. Further pumping systems are known from the European patent document 1,106,547 A; the German patent documents 39 00 718 A; 1,087,520 A; and the U.S. Pat. documents 2,687,280 and 3,391,963.

The state of the art comprises a pumping system containing two pumps each fitted with a powder aspirating plunger driven by a pneumatic cylinder. The two pumps are driven in opposite directions, therefore one carrying out a suction stroke while the other carries out a pressure stroke. During the suction stroke the associated powder aspirating plunger aspirates powder from a powder supply into its metering chamber. The metered quantity of powder introduced into the metering chamber is expelled by compressed air at the end of the suction stroke out of said metering chamber into a powder feed conduit. Thereupon said plunger will return during a pressure stroke into its initial position from which it will again aspirate powder from said powder supply during a suction stroke. The quantity moved per unit time depends on the frequency of plunger reciprocation. A pumping system of this kind was described in the patent document WO 03/024612 A1 only subsequently to the priority date of the present, new patent application.

Moreover so-called injectors are known wherein, based on the venturi principle, a conveying airflow moves from an outlet nozzle into a collecting nozzle and generates a partial vacuum in the intermediate space, said partial vacuum aspirating coating powder from a powder supply into said conveying airflow. Said injectors incur the drawback relative to the above plunger pumps that the powder particles abrade the collecting nozzle and hence that after some time the efficiency of powder conveyance shall drop. Moving powder in this manner entails a large amount of compressed air per unit time.

The above cited plunger pumps are free of those drawbacks. However they incur another drawback, namely that they move the powder in discontinuous strokes and that more uniform powder conveyance and delivery of larger quantities of powder per unit time require a higher frequency of plunger motion. On the other hand the plunger frequency is limited by the rate at which the valves in the pump's flow paths can be driven. Also care must be paid that the powder particles in the pumps and in their flow paths shall not be squeezed, shall not sinter or adhere to one another and that gaps, recesses and the like shall not arise where powder might accumulate.

SUMMARY

The objective of the present invention is to design a pumping system comprising at least one volumetrically expelling element in such manner that a defined and optionally also a large quantity of conveyed powder can be moved while averting the above cited drawbacks. In particular the invention shall offer long service life with high processing reliability and high, constant quantity of powder moved per unit time (constant powder rate for a given configuration and given settings of the pumping system).

Further features of the invention are defined in the dependent claims.

The pumping system of the invention is characterized by a time controller initiating powder conveyance out of the metering chamber as a function of a predetermined time delay since a predetermined operational state, namely compressed air being introduced into the metering chamber and the metered quantity of powder accumulated till the end of said time delay being forced out of the said metering chamber by means of the compressed air.

The present invention also comprises a powder spray coating apparatus which is fitted with at least one such pumping system.

The invention also comprises a method for conveying powder, in particular coating powder.

The present invention is elucidated below by preferred implementing modes and in relation to the appended drawings.

DETAILED DESCRIPTION

Figure 1:
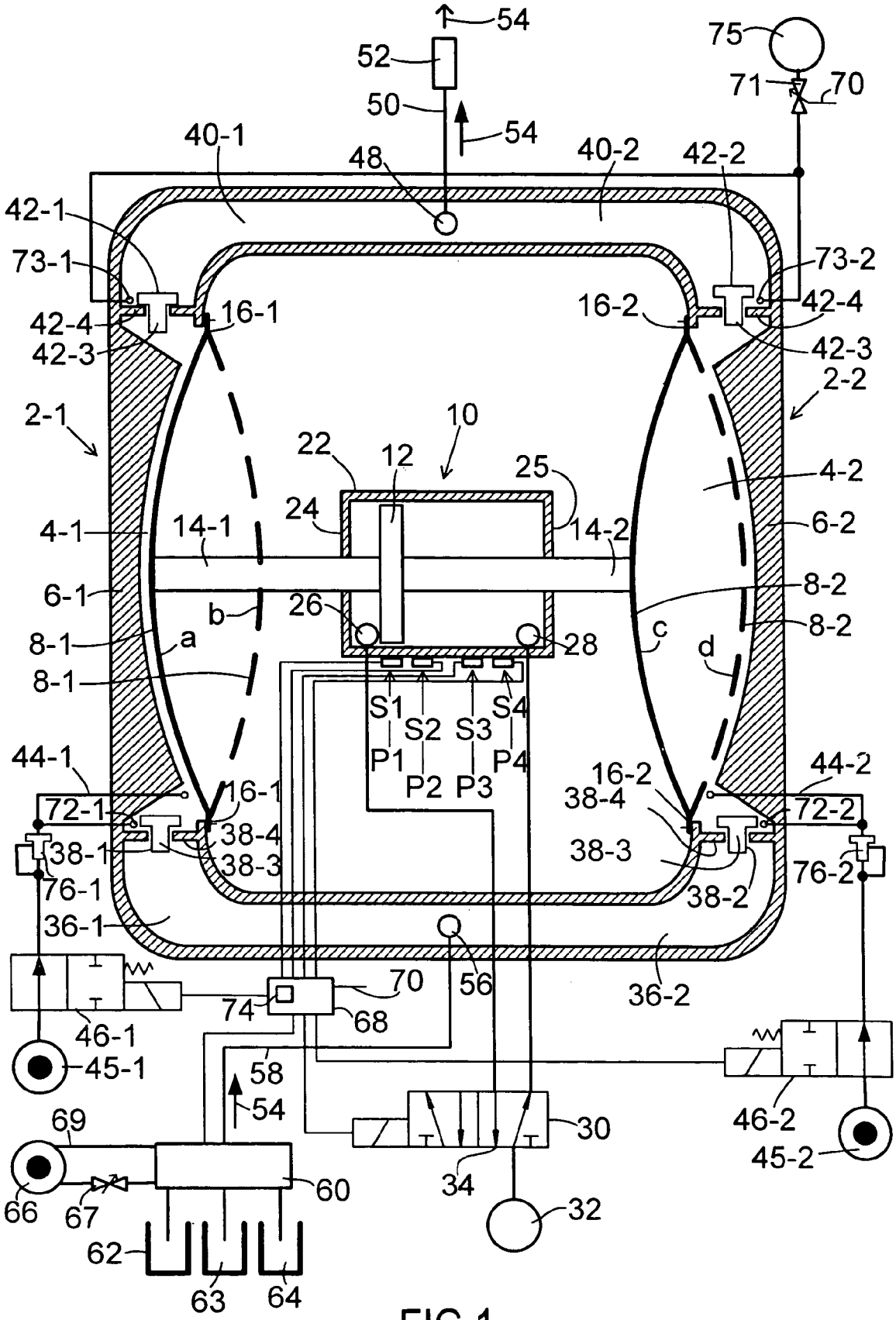
FIG. 1 schematically and in partial cross-section shows a double-pump apparatus of the invention, FIG. 2 schematically shows parts of FIG. 1 jointly with an operational diagram to illustrate the invention.

FIG. 1 shows a pumping system of the present invention to be used for powders, in particular coating powders, said system comprising two powder pumps 2-1 and 2-2 each containing a metering chamber 4-1 and 4-2, respectively, that is bounded by a chamber housing 6-1, 6-2 and an expelling element in the form of a flexible membrane 8-1 or 8-2.

The two membranes 8-1 and 8-2 are driven jointly by a drive 10 configured between them. The drive 10 may be mechanical, electrical or, according to FIG. 1, pneumatic. The pneumatic drive shown in FIG. 1 contains a drive plunger 12 displaceable transversely to the membranes 8-1 and 8-2, plunger rods 14-1 and 14-2, respectively, extending away from said plunger and in the direction of motion, the ends of said rods away from said plunger being linked with the membrane 8-1 or the other membrane 8-2, as a result of which the two membranes always are ganged to the drive plunger 12 and jointly carry out their motions with it. The plunger rods 14-1 and 14-2 respectively act on the center of the membrane 8-1 and membrane 8-2 which move in the plunger axial direction. The peripheral membrane edges 16-1, respectively, 16-2 are affixed to a portion of the chamber housing 6-1 and 6-2 and, jointly with the membrane center, they cannot move together with the drive plunger 12 transversely to the membrane. Within the scope of this disclosure, the term "membrane excursion" in each case refers to that membrane surface which is linked to the drive plunger 12 for purposes of common motion, but not those peripheral membrane edges 16-1 and 16-2 that are affixed to the chamber housing.

The chamber housing 6-1 and 6-2 of the two powder pumps 2-1 and 2-2 preferably are segments of a common housing part or a housing which is shown in cross-section in FIG. 1.

Except for their peripheral edges 16-1 and 16-2, the membranes 8-1 and 8-2 are displaced forward during a pressure stroke and back during a suction stroke by means of the joint drive 10. In FIG. 1 the left-hand membrane 8-1 is in a final position "a" which is the final position of the pressure stroke and the initial position of the suction stroke. In this configuration the volume of the associated metering chamber 4-1 will be its minimum. In said configuration the membrane 8-1 preferably shall not fully abut the chamber housing 6-1, instead being a slight distance away from it in order to preclude powder particles from being jammed between the membrane 8-1 and the chamber housing 6- 1. The same conditions apply for the right-hand membrane 8-2 of FIG. 1 when said membrane 8-2 is in a final position "d" that is the final position of its pressure stroke and the initial position of its suction stroke. However FIG. 1 shows the right-hand membrane 8-2 in a left final position "c" which is the final position of the suction stroke and the initial position of its pressure stroke. The two membranes 8-1 and 8-2 are always driven jointly to the left or to the right by the drive plunger 12, and consequently the left-hand membrane 8-1 carries out its pressure stroke when the right-hand membrane 8-2 carries out its suction stroke, and vice-versa.

The drive plunger 12 is configured within a cylinder 22 which is fitted with a compressed air control aperture 26 and 28 near the cylinder end faces 24 and 25 on each side of the drive plunger 12, said aperture being alternatingly connected through a reversing valve 30 to a source of compressed air 32 or to a venting aperture 34 to the external atmosphere for venting. In FIG. 1, the compressed air control aperture 28 is connected to the compressed air source 32 and accordingly said source's compressed air has forced the drive plunger 12 into the left position in FIG. 1 while the compressed air control aperture 26 is connected to the venting aperture 34 of the reversing valve 30. The reversing valve 30 operates in a manner that following reversal, the compressed air control aperture 28 shown on the right is connected to the venting aperture 34 and the compressed air control aperture 26 is connected to the compressed air source 32. In this reversed position—which is not shown in FIG. 1—of the reversing valve 30, the compressed air drives, from left to right, the drive plunger 12 together with the two membranes 8-1 and 8-2. As a result the left—hand membrane 8-1 is displaced from its initial suction stroke position (pressure stroke final position) "a" into its suction stroke final position (pressure stroke initial position) "b". Simultaneously the right—hand membrane 8-2 is displaced from its suction stroke final position (pressure stroke initial position) "c" into its suction stroke initial position (pressure stroke final position) "d". The two membranes 8-1, 8-2, respectively, are schematically shown in their left final positions by a solid line and in their right—hand final positions by a dashed line.

Each metering chamber 4-1 and 4-2 is fitted with a powder intake duct 36-1 and 36-2, respectively, associated with a powder intake valve 38-1 and 38-2; further with a powder outlet duct 40-1, 40-2, respectively, associated with a powder outlet valve 42-1 and 42-2; and a compressed gas intake duct 44-1, 44-2, respectively, associated with a compressed gas intake valve 46-1 and 46-2.

To aspirate a metered quantity of powder into the metering chamber 4-1 on the left in FIG. 1, the left-hand powder intake valve 38-1 is made to open and the left—hand powder outlet valve 42-1 and the left-hand powder intake valve 38-1 are made to close, as a result of which the left-hand membrane 8-1 moving in the suction stroke direction from the suction stroke initial position "a" into the suction stroke final position "b" is able to aspirate powder—by means of the powder intake duct 36-1—into the left-hand metering chamber 4-1. To convey the metered quantity of powder from the metering chamber 4-1 shown on the left into the left-hand powder outlet duct 40-1, the left-hand powder intake valve 38-1 is made to close and the left-hand powder outlet valve 42-1 as well as the left-hand pressure gas intake valve 46-1 are made to open, whereby compressed gas, for instance compressed air, may flow from the compressed gas source 45-1, for instance a compressed air source, through the left-hand compressed gas intake duct 44-1 into the left-hand metering chamber 4-1 and further may force the metered quantity of powder from the metering chamber 4-1 into the left-hand powder outlet duct 40-1. During or after the powder expulsion from the left-hand metering chamber 4-1 and depending on the design of the pumping system, the left-hand membrane 8-1 is returned by the drive plunger 12 from the right-hand suction stroke final position "b" into the left-hand suction stroke initial position "a"—a procedure termed herein as the pressure stroke—in order that said pumping system next may carry out another suction stroke.

The membrane 8-2 shown on the right of FIG. 1 and its associated valves 38-2, 42-2, 45-2 and 46-2 driven by the drive 10 carry out corresponding operations regarding the associated right-hand metering chamber 4-2, the associated right-hand powder intake duct 36-2 and the associated right-hand powder outlet duct 40-2 and right-hand compressed gas source 45-2, for instance a compressed air source. The right-hand membrane 8-2 however carries out its pressure stroke when the left-hand membrane 8-1 carries out its suction stroke, and vice-versa.

Each of the two powder intake valves 38-1 and 38-2 is fitted with a valve element 38-3 and a valve seat 38-4 having a valve aperture that may be closed by the valve element 38-3. The two powder outlet valves 42-1 and 42-2 each are fitted with a valve element 42-3 and a valve seat 42-4 having a valve aperture which may be sealed by the valve element 42-3.

The two powder outlet ducts 40-1 and 40-2 shown in FIG. 1 share one powder discharge aperture 48 which is connected through a powder feed conduit 50 to a powder receiver, for instance a powder spray device 52 to spray the powder 54 onto an object to be coated or a powder buffer receptacle to feed the powder 54 to a powder spray device 52, or a powder collecting receptacle.

Figure 2:
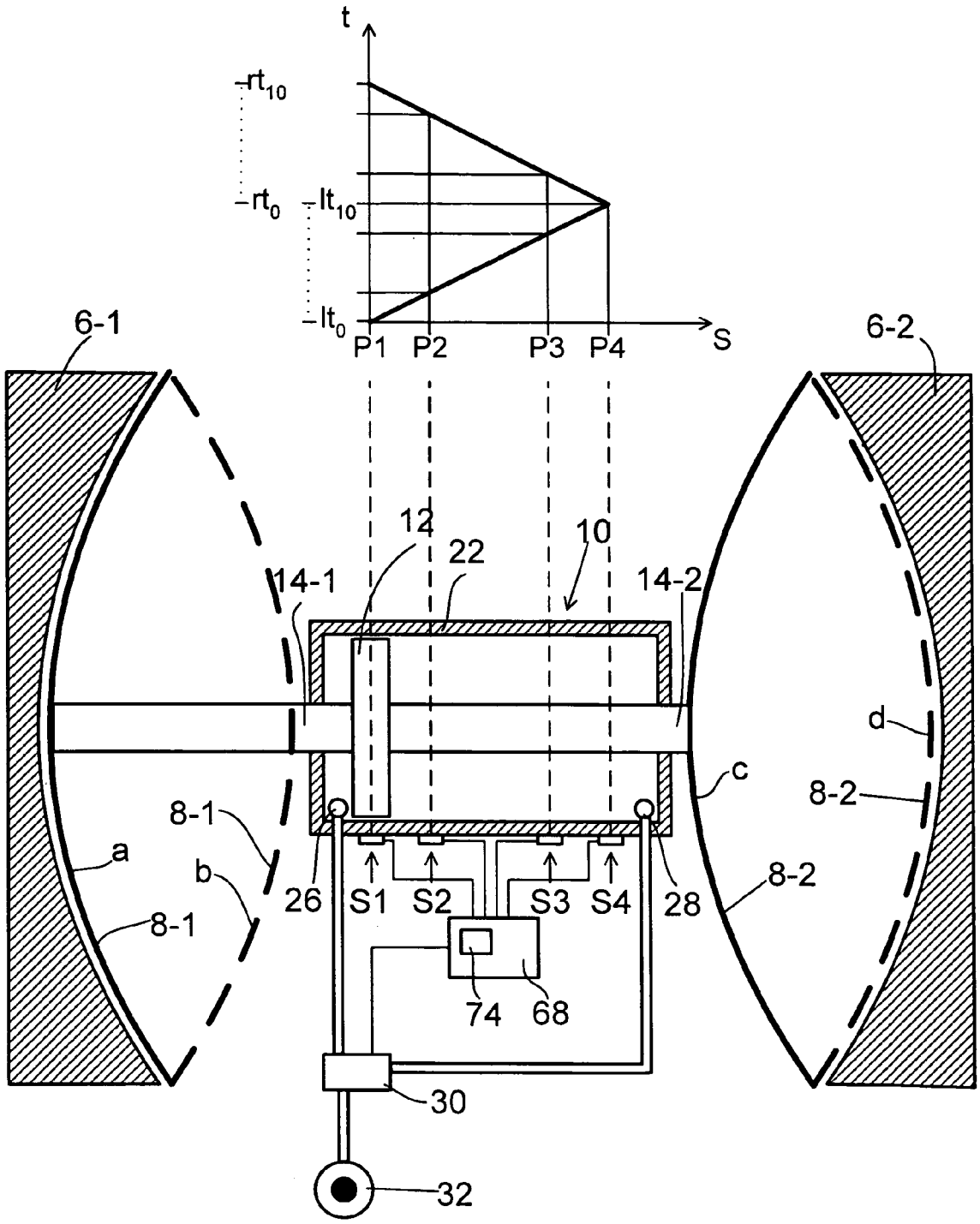

The two powder intake ducts 36-1 and 36-2 may be connected separately or jointly to a common powder source or to several powder sources. In FIG. 2 said ducts are shown preferably connected through a common powder intake aperture 56 and through a powder suction conduit 58 to a color changer 60. The color changer 60 is a duct or powder switch, and depending on the switch position, one of several powder containers 62, 63, 64 etc. shall be selectively communicating with the powder suction conduit 58. Said color changer 60 is switched by means of a controlled valve system 67 preferably using compressed gas, for instance compressed air, from a compressed gas source, for instance a compressed air source 68.

The color changer 60 also may be switched into a position wherein none of the powder containers 62, 63, 64, but instead the compressed air source 66 is connected through a compressed gas conduit 69 to the powder suction conduit 58, as a result of which compressed gas, for instance compressed air, may flow through the powder intake ducts 36-1, 36-2 and their powder intake valves 38-1, 38-2, through the metering chambers 4-1 and 4-2, and then also through their powder outlet valves 41-2 and 42-2, respectively, and the powder outlet ducts 40-1, 40-2 to the powder feed conduit 50 and from latter through the powder spray device 52 into the external atmosphere in order to rid all of the equipment of powder residues. Moreover, using preferably an electronic or computerized pump control unit 68, simultaneously or following such a cleaning, compressed gas, for instance compressed air, may be expelled from a compressed gas source 45-1, 45-2, respectively, through the compressed gas intake duct 44-1 and 44-2 and their associated controlled compressed gas intake valves 46-1 and 46-2 into one end of the metering chamber 4-1 and 4-2 and hence powder is blown out of the other chamber end through the powder outlet valve 42-1, 42-2, respectively, and through the adjoining powder outlet duct 40-1 and 40-2 through the powder feed conduit 50 and the powder spray device 52. The compressed gas intake duct 44-1 and 44-2 may be fitted with a compressed gas cleaning duct 72-1, 72-2, respectively, which is pointed toward the downstream parts of the particular powder intake valve 38-1 and 38-2 in order to cleanse these of powder particles unless the compressed gas intake duct 44-1 and 44-2 already has been pointed toward the downstream zones of the powder intake valves 38-1 and 38-2 and thereby already is cleaning them.

Simultaneously with or following this cleaning, the pump control unit 68 may open through a control line 70 a valve 71 to blow a compressed gas, for instance compressed air, from a compressed gas source 75 through a conduit 73-1, 73-2, respectively, feeding additional gas onto the downstream parts of the powder outlet valves 42-1 and 42-2 toward which said gas-addition conduit is pointing and to guide said compressed gas through the powder outlet ducts 40-1 and 40-2 and the powder feed conduit 50 to the powder spray device 52 and from there into the external atmosphere.

The pump control unit 68 drives all controlled valves and the color changer 60.

The pump control unit 68 contains a time controller 74 which—as a function of an predetermined time delay that has elapsed since a predetermined suction stroke position, for instance P1 or P2 of the left-hand membrane 8-1 and a predetermined suction position, for instance P4 or P3 of the right-hand membrane 8-2—initiates powder conveyance out of the pertinent metering chamber 4-1, 4-2, respectively. At the end of the delay time, the compressed gas from the compressed gas source 45-1, 45-2, respectively, is introduced through the compressed gas intake valve 46-1 and 46-2 into the metering chamber 4-1 and 4-2, as a result of which the quantity of powder metered until the end of said time delay shall be expelled by said compressed gas out of the metering chamber, namely through the particular powder outlet valve 42-1, 42-2, respectively, into the powder feed conduit and from there to the powder spray device 52 or into a powder container.

In one embodiment mode, the said "predetermined suction stroke position" may be the suction stroke initial position "a" corresponding to PI for the membrane 8-1 on the left and "d" corresponding to P4 for the right-hand membrane 8-2, which for the left-hand membrane 8-1 in FIG. 1 is the position "a" shown in a solid line and which for the right-hand membrane 8-2 shown on the right in FIG. 1 is the position "d" shown in a dashed line.

The suction stroke initial position "a" for the left-hand membrane 8-1 in FIGS. 1, 2 is detected by a sensor S1 at a position P1. This position is simultaneously also the pressure stroke final position of the membrane 8-1. As regards the right-hand membrane 8-2, the position P1 is detected by the sensor S1 as being the suction stroke final position and simultaneously the pressure stroke initial position.

The suction stroke initial position "d" of the membrane right-hand 8-2 in FIGS. 1, 2 is detected by the sensor S4 in a position P4. Said position P4 simultaneously is the pressure stroke final position for the right-hand membrane 8-2. As regards the left-hand membrane 8-1, the position P4 at the sensor S4 is the suction stroke final position and simultaneously the pressure stroke initial position.

When the membranes 8-1 and 8-2 have reached a final position "a" and "c", respectively or "d" and "b", respectively, corresponding to the sensor S1 at P1 to the sensor S4 at P4, respectively, the pertinent sensor transmits a signal to the pump control unit 68 to reverse the motion of the drive plunger 12 and hence also that of the two membranes in either direction by applying compressed air to the compressed air control aperture 26 to the compressed air control aperture 28 and by venting the other, particular compressed air control aperture.

When, in the particular embodiment of the pump device, the said "predetermined suction stroke position" is the suction stroke initial position "a" or "d" of the membrane 8-1 or the membrane 8-2, then, by means of the signals from the sensors S1 and S4, the time controller 74 of the pump control element 68 recognizes when the membranes 8-1 and 8-2 have reached the particular final position.

The sensors S1 and S2 may be mounted anywhere the positions of the membranes 8-1 ands 8-2 can be ascertained, in particular places at the cylinder 22 or the drive plunger 12 or the plunger rods 14-1 and 14-2 or the chamber housing 6-1, 6-2 or the membranes 8-1 and 8-2. In a preferred embodiment mode, the said sensors are mounted on the cylinder 22, preferably on its outside, namely at positions P1 and P2 assumed by the drive plunger 12 when the membranes 8-1 and 8-2 assume one of the two final positions.

According to the invention, metered powder may be expelled by means of compressed gas from the compressed gas source 45-1 from the left-hand metering chamber 4-1, and metered powder may be expelled by means of compressed gas from the compressed gas source 54-2 out of the right-hand metering chamber 4-2 through the pertinent powder outlet valve 42-1, 42-2, respectively, not only when reaching the suction stroke final position "b" of the left-hand membrane 8-1 and "c" of the right-hand membrane 8-2, but also at an earlier time if initially a modest quantity of powder is present in the particular metering chamber. This feature is attained by using a time delay which preferably shall be adjustable at the time controller 74. As a result modest metered powder quantities may be expelled from the particular metering chamber 4-1 or 4-2 before the associated membrane 38-1 or 8-2 has completed its full suction stroke. In this procedure the particular associated powder intake valve 38-1, 38-2, respectively, shall be always closed at once when compressed gas from the compressed gas source 45-1, 45-2, respectively, is blown through the compressed gas intake duct 44-1, 44-2, respectively, into the particular metering chamber 4-1 or 4-2. Depending on the magnitude of the predetermined time delay, a varying quantity of powder was aspirated into the pertinent metering chamber by the time of powder expulsion. Consequently, by adjusting different time delays, the metered quantify of conveyed powder of the metering chambers 4-1 and 4-2 may be varied independently of the frequency at which the membranes 8-1 and 8-2 are reciprocated by their joint drive 10. The membrane frequency of motion may be kept constant or it also may be variable.

In the preferred embodiment of the invention, the "predetermined suction stroke position" is situated between the suction stroke initial position "a", "d", respectively, and the suction stroke final position "b", "a", respectively,—preferably nearer the suction stroke initial position than the suction stroke final position.

In the preferred embodiment of the invention, said predetermined suction stroke position for the membrane 8-1 shown on the left in FIGS. 1 and 2 shall be defined by a sensor S2 at a position P2 and for the right-hand membrane 8-2 of FIGS. 1 and 2 by a sensor S3 at a position P3. The two sensors S2 and S3, as well as the sensors S1 and S4, may be mounted in any arbitrary position where they are able to detect defined positions of the membrane 8-1 and 8-2 between their final positions a, b, c and d, for instance at the cylinder 22, at the drive plunger 12, at latter's plunger rods 14-1 and 14-2 or at the very membranes or at the chamber housing 6-1, 6-2. In said preferred embodiment of the invention, said sensors are mounted on the cylinder 22. A sensor signal is transmitted when the drive plunger 12 or a given part of the drive plunger 12 is adjacent to the particular sensor. The sensor S2 always transmits a signal to the time controller 74 of the pump control element 68 when the left-hand membrane 8-1 reaches a position—corresponding to the sensor S2—which is selected in such manner that during the suction stroke it corresponds to the predetermined suction stroke position of the left-hand membrane 8-1. Correspondingly the sensor S3 always transmits a signal to the time controller 74 of the pump control unit 68—when the right-hand membrane 8-2 reaches a position corresponding to the sensor S3—so selected that during the suction stroke it corresponds to the predetermined suction stroke position of the right-hand membrane 8-2. On account of the time sequence of the signals of the mounted sensors, the time controller shall ascertain whether, upon receiving a signal from the sensor S2 S3, respectively, the left-hand membrane 8-1 or the right-hand membrane 8-2 carried out a suction stroke at that time. In case it is a suction stroke, the time delay unit 74 initiates the predetermined time delay at the end of which compressed gas is allowed to flow into the metering chamber 4-1, 4-2, respectively, to expel the metered quantity of powder.

In the preferred embodiment, the excursion of the membrane 8-1 and 8-2 always is the same for all strokes and extends from the sensor S1 to the sensor S4 and vice-versa. The excursion also might be shortened by appropriately controlling the compressed air by means of the reversing valve 30.

FIG. 2 shows a diagram above the pump system, the horizontal axis S representing the stroke of the drive plunger 12 corresponding to the excursion of the membranes 8-1 and 8-2, the final position P1 being at the sensor S1, the final position P4 being at the sensor S4, the predetermined suction partial stroke position P2 being at the sensor S2 and the predetermined suction partial stroke position P3 being at the sensor S3. The suction stroke times $It_0$ through $It_{10}$ for the left-hand membrane 8-1 are plotted on the vertical diagram axis. The pressure stroke of the left-hand membrane 8-1 is seen in the opposite direction, namely from the final position P4 to the final position P1. When the left-hand membrane 8-1 moves from the suction stroke initial position P1 to the right, it shall reach the predetermined suction partial stroke position P2 at the sensor S2. When this predetermined suction partial stroke position P2 has been reached, the time controller 74 initiates a predetermined and preferably variably adjustable delay time upon the lapsing of which the compressed gas of the compressed gas source 45-1 is introduced through the compressed gas intake duct 44-1 into the metering chamber 4-1 in order that the compressed gas shall force the quantity of powder heretofore aspirated into this metering chamber 4-1 through the powder outlet valve 42-1 into the powder feed conduit 50 to expel it from there out of the powder spray device 52. The end of the delay time may be any time at which the drive plunger 12 and appropriately the left-hand membrane 8-1 are situated between the predetermined suction partial stroke position P2 at the sensor S2 and the suction stroke final position P4 at the sensor S4.

Once the drive plunger 12 has reached the sensor S4 in the final position P4, the pump control unit 68 will be notified by a signal from the sensor S4. Thereupon the pump control unit 68 switches the reversing valve 30 into the position shown in FIG. 1 wherein compressed air from the compressed air source 32 forces the drive plunger 12 back into the other final position P1 at the sensor S1. The cycle is renewed thereupon by a signal from the sensor S1. The reversal of the motion of the two membranes 8-1 and 8-2 and hence also that of the drive plunger 12 from one direction of motion to the other at the points of displacement in each case may take place in the presence of a time delay or not. The time delay may be set in permanent or in variable manner, for instance it may be program-controlled.

When the drive plunger 12 is moved from the shown right-hand final position P4 at the sensor S4 to the shown left-hand final position P1 at the sensor S1, the left-hand membrane 8-1 will be moved from its pressure stroke initial position "b" shown in dashed lines and corresponding to the suction stroke final position into the pressure stroke final position "a" which is shown by the solid line 8-1.

During this pressure stroke of the left-hand membrane 8-1, the shown right-hand membrane 8-2 is displaced by the drive plunger 12 from its suction stroke initial position "d" (pressure stroke final position) shown in dashed lines into the suction stroke final position "c" shown in solid lines, where this membrane 8-2 aspirates powder through the powder intake valve 38-2 from the color changer 60 into its metering chamber 4-2. When, during this suction stroke, the drive plunger 12 will come from the position P4 at S4 and reaches the predetermined suction stroke position P3 at the sensor S3, a signal from this sensor S3 shall cause the time controller 74 to initiate a preferably variably adjustable time delay. When this time delay lapses, the pump control device 68 will be triggered by the time controller 74 and compressed gas of the compressed gas source 45-2 shown on the right in FIG. 1 is introduced through said source's compressed gas intake valve 46-2 and through the compressed intake duct 44-2 into the right-hand meter chamber 4-2 in order that the quantity of powder that was aspirated up to this time and was commensurately metered shall be expelled from this metering chamber 4-2 through its powder outlet valve 42-2 to the powder feed conduit 50 and from there through the powder spray device 52. The time at which the powder is expelled by the compressed gas from the metering chamber 4-2 may be situated at an arbitrary point of the motion of the drive plunger 12 between the predetermined suction stroke position P3 at the sensor S3 and the suction stroke final position P1 at the sensor S1. This feature corresponds to a time interval between the time scale rt 0 to rt 10 shown in the diagram in the upper half of FIG. 2. When the right-hand membrane 8-2 reaches its suction stroke final position "c", the left-hand membrane 8-1 will simultaneously reach its pressure stroke final position "a" which simultaneously becomes its suction stroke initial position.

Thereupon the cycle starts anew.

The numbers of the time axes It 0 through It 10 and rt 0 to rt 10 are selected arbitrarily.

It may be appropriate—when the compressed gas feed valves 46-1 and 46-2, which are driven by the pump control unit 68 as a function of signals transmitted by the final position sensors S1 and S4, cannot be positioned very close to the pertinent metering chamber 4-1, 4-2, respectively,—to mount a check-valve 76-1, 76-2, respectively, in the compressed gas intake duct 44-1 or 44-2 or their supply line to the controlled valve, near the intake of the compressed gas intake duct 44-1 or 44-2 into the metering chamber 4-1 or 4-2, said check valve automatically opening in the direction of the feed of compressed gas and automatically closing in the opposite direction of flow. In this manner powder particles are precluded from migrating back from the metering chamber 4-1, 4-2, respectively, into the compressed gas intake valves 46-1 and 46-2.

In the preferred embodiment of the invention, the powder intake valves 38-1 and 38-2 and/or the powder outlet valves 42-1 and 42-2 are not controlled valves but valves that open and close automatically in the manner of a check valve. In this design the powder intake valves 38-1 and 38-2 are configured in such manner that they are opened by suction, i.e. partial vacuum in their metering chamber 4-1, 4-2, respectively, during the suction stroke of the pertinent membrane 8-1 or 8-2, in order to aspirate powder from the associated powder container 62, 63 or 64 through the powder intake duct 36-1, 36-2, respectively, into the metering chambers 4-1 or 4-2. The gas pressure of the compressed gas source 45-1, 45-2, respectively, used to expel the metered quantity of powder from the pertinent metering chamber 4-1, 4-2, respectively, is larger than the partial vacuum and causes automatic closure of the powder intake valve 38-1, 38-2, respectively. In another embodiment mode, the powder intake valves 38-1 and 38-2 and/or the powder outlet valves 42-1 and 42-2 are valves driven by the pump control unit 68.

The powder outlet valves 42-1 and 42-2 are configured in opposition to the power intake valves. As a result the pertinent powder outlet valve 42-1 and 42-2, respectively, is closed by the partial vacuum during the suction stroke of the associated membrane 8-1 and 8-2, respectively, and is opened by the compressed gas in the metering chambers in order to expel the metered quantity of powder, namely to force the metered quantity of powder by means of the compressed gas through the opened powder outlet valve 42-1 and 42-2, respectively, and through the adjoining powder outlet duct 40-1 and 40-2, respectively, into the powder feed line 50 and from latter into the powder spray device 52. The compressed gas overcomes the partial vacuum.

Instead of being linked to a color changer 60, the powder suction conduit 58 might be connected directly to one of the powder containers 62, 63 or 64.

The powder coating device 52—which is also conventionally termed powder spray device—may be fitted with a nozzle or a rotary element or a rotating nozzle to coat or spray the powder, in the manner known in the state of the art.

Accordingly the present invention creates a method for conveying powder, in particular coating powder, whereby, by enlarging the volume of a metering chamber 4-1 and/or 4-2, powder may be aspirated from a powder source into the metering chamber 4-1 and/or 4-2, respectively, and thereupon the metered quantity of powder can be expelled by compressed gas out of the metering chamber. The cycle is repeatable in periodic manner. The sensors S1, S4, S2 and S3 ascertain a predetermined phase or position of the periodic volume changes of the metering chamber 4-1, 4-2, respectively, and, following a predetermined time delay beyond the said predetermined phase, the quantity of powder metered up to that time shall be expelled by compressed air out of the metering chamber 4-1, 4-2, respectively.

It is clear enough that the invention also may be implemented using only one metering chamber 4-1 or 4-2, that is without a second metering chamber either 4-2 or 4-1. It is further understood that—in lieu of a single drive 10 for both membranes 8-1 and 8-2 —each membrane 8-1 and 8-2 may be fitted with its own drive 10.

Employing one membrane 8-1 or 8-2 as the expelling element allows compactness. However the present invention is not restricted to employing a membrane, for which a piston in a cylinder may be substituted.

Figure 3:
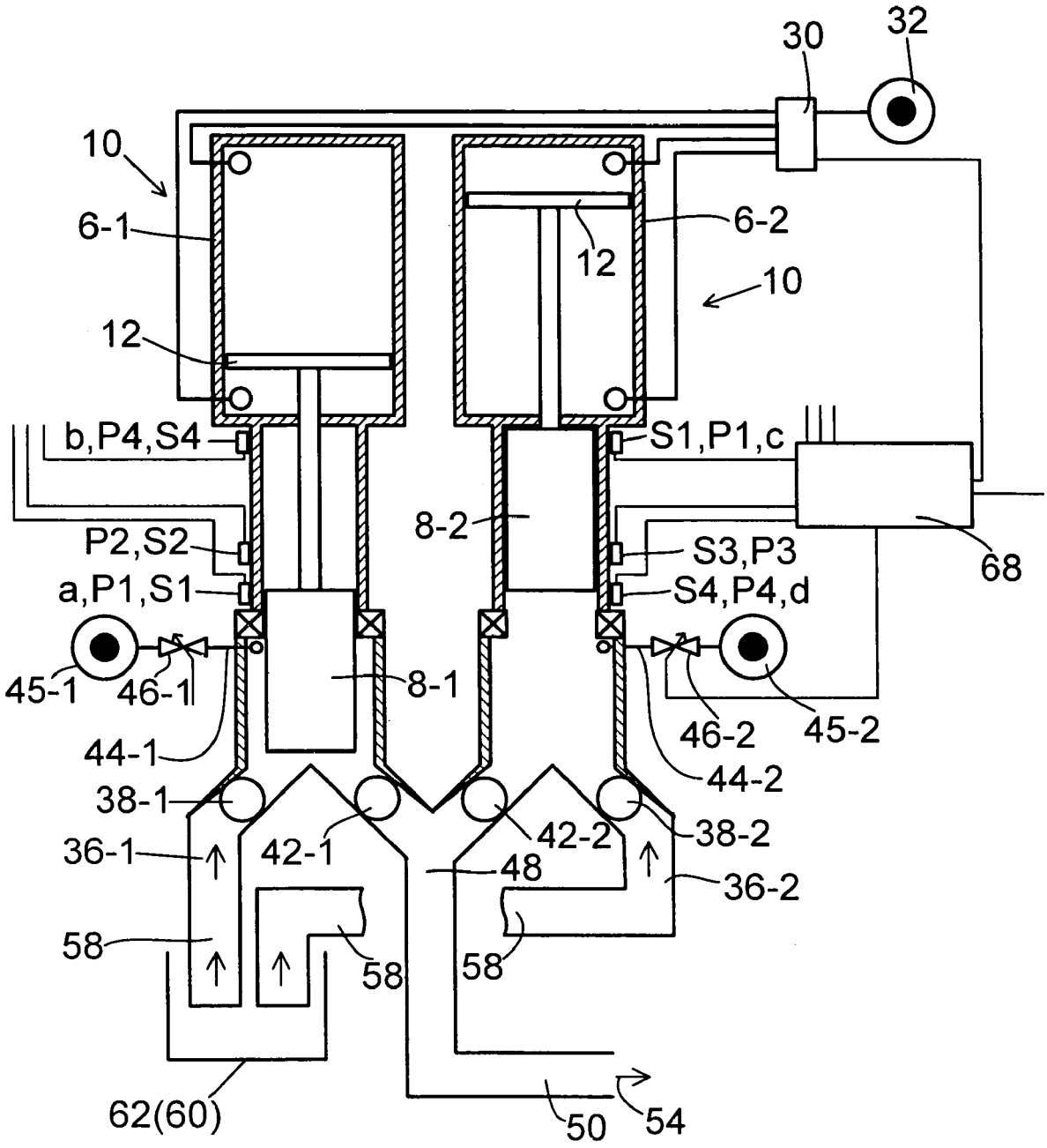
FIG. 3 shows schematically and partly in cross-section another embodiment mode of a double pump apparatus of the invention.

FIG. 3 shows an embodiment of the present invention wherein—in lieu of a membrane—a piston is used as the expelling element. FIG. 3 furthermore shows the feasibility of using an associated particular drive for each expelling element (membrane or piston) instead of a single drive for two or more expelling elements (membranes or pistons).

Identical components shown on one hand in FIGS. 1 and 2 and on the other hand in FIG. 3 are denoted by the same reference symbols. Accordingly the above description relating to FIGS. 1 and 2 also applies to FIG. 3. FIG. 3 furthermore shows the feasibility not to configure the sensors S1, S2, S3 and S4 to detect the drive plunger 12, but instead to detect the particular position of the expelling piston 8-1, 8-2, respectively. However the design shown in FIG. 3 also allows associating said sensors not with the expelling pistons 8-1 and 8-2 but with the drive plunger 12 or another element.

In FIG. 3 each powder intake duct 36-1 and 36-2 is fitted with its own powder suction conduit 58 which may run to different powder sources (powder containers or color changers) or, according to FIG. 3, to a common powder source, i.e. a powder container 62. Instead of this embodiment, however, a common powder suction conduit 58 similar to that of FIG. 1 may be used for both powder intake ducts 36-1 and 36-2. Said ducts may run directly to a powder container, for instance 62, or to a color changer 60 as in FIG. 1.

Features shown on one hand in FIGS. 1 and 2 and on the other hand in FIG. 3 may be exchanged to result in new combinations.

The present invention also applies to combinations of three or more powder pumps of which the powder intake ducts are connected or connectable to a common or different powder sources and of which the powder outlet ducts all are connected to one common powder feed aperture, a pump control unit being designed to drive the pumps in a manner that their suction strokes shall be mutually offset in time and that their pressure strokes shall also be correspondingly offset, as a result of which the pumps aspirate metered quantities of powder in time offset manner, however at least one pump shall be fitted with its expelling unit (membrane or powder expelling piston) in an intermediate position between final positions when the expelling element of at least one of the other pumps shall be in a final position.

All said compressed gases and compressed gas sources may be compressed air and compressed air sources, respectively. However other compressed gases, for instance noble gases, and correspondingly other compressed gas sources, for instance noble gas sources, may be used. Two or more or all said compressed gas sources jointly may constitute a single compressed gas source from which the various compressed gases may be tapped.

As regards the preferred embodiments of the present invention shown in FIGS. 1, 2 and 3, the pump control unit 68 is designed to implement the reversals of the motions of the expelling elements 8-1 and 8-2 from suction stroke to pressure stroke and vice-versa. as a function of signals from the sensors S1 and S4 which each generate a signal when the expelling element 8-1 and 8-2, respectively, is situated along the path of the stroke at either of two predetermined motion reversal positions.

This feature represents only one way the pump control unit 68 may ascertain when the particular expelling element 8-1, 8-2 is situated in a predetermined suction stroke position.

Figure 4:
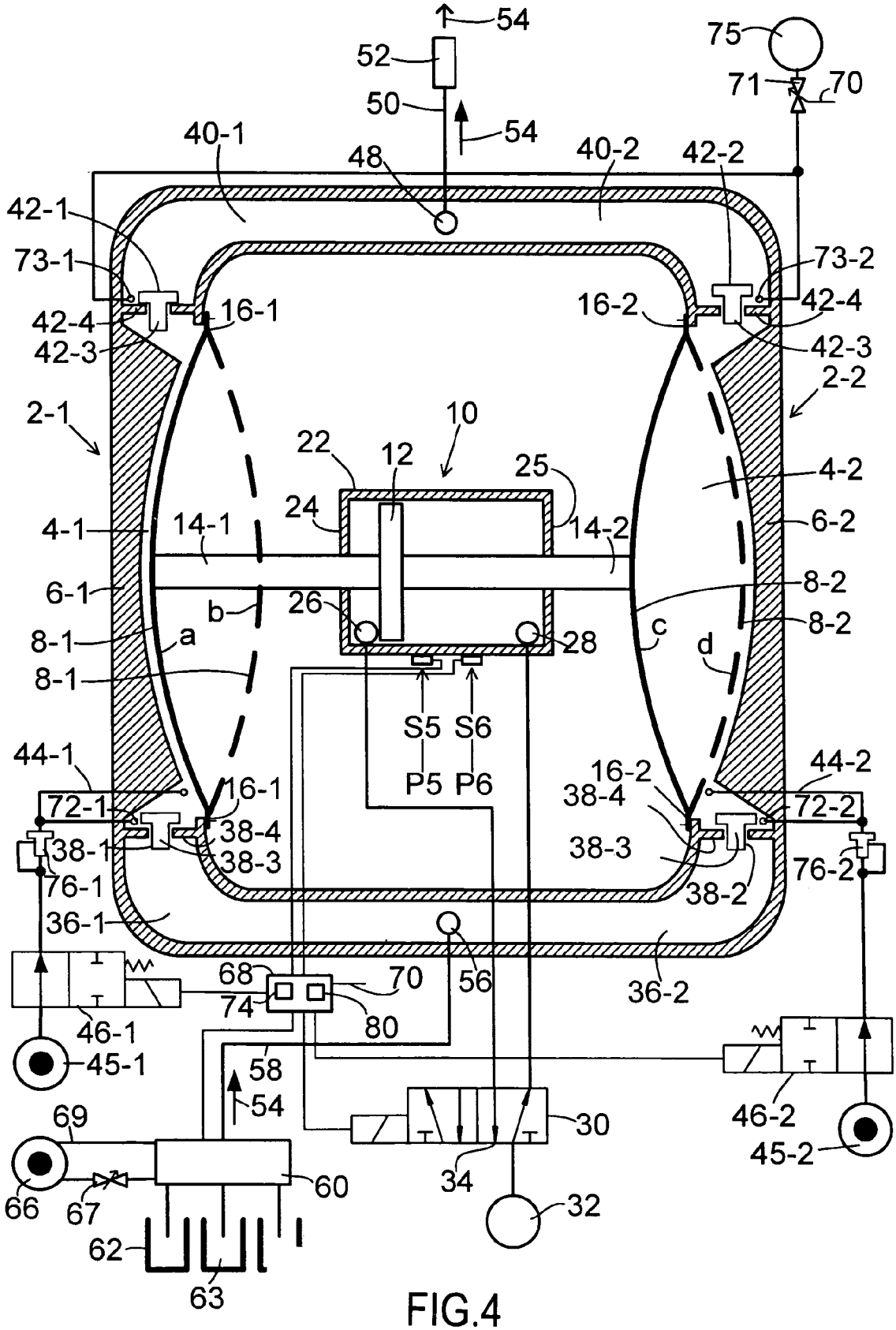
FIG. 4 shows schematically and partly in cross-section another double pump apparatus of the invention.

Another way is incorporated in another preferred embodiment of the invention which is schematically shown in FIG. 4. As regards the embodiment of FIG. 4, the pump control unit 68 contain a timer 80 by means of which the time-delayed injection of compressed gas into the metering chamber 4-1, 4-2, respectively, is determined by a given cycle time. Following that cycle time, the pump control unit 68 transmits control signals to the reversing valve 30 which on account of application and exhaust of compressed gas to and from the cylinder 22 of the drive 10, implements the motions of the expelling elements 8-1 and 8-2 and hence the mutually opposite volume changes of the two metering chambers 4-1 and 4-2.

Said control signals, preferably the control signal initiating the suction stroke, at the same time also initiate the time delay of the time controller 74. As soon as the predetermined time delay has lapsed, compressed gas is introduced through one compressed gas intake valve 46-1 into the metering chamber 8-1 or through the other compressed gas intake valve 46-2 into the other metering chamber 4-2 to convey powder in the manner already described above in relation to FIGS. 1 through 3. The deviation from the design shown in FIGS. 1 through 3 is that the pump control unit 68 does not ascertain the predetermined suction stroke position of the expelling elements 8-1 and 8-2 by means of sensor signals (sensors S1, S2, S3, S4), but by means of control signals which are generated when the cycle time of the timer 80 has lapsed.

It is assumed in the above description that the drive plunger 12 and hence also the expelling elements 8-1 and 8-2 di reach their predetermined final positions before the cycle time lapsed. Deviations between the predetermined final positions and the actually reached ones may arise if the impedances to motion of the elements to be displaced change, for instance on account of material wear, material fatigue or soiling. To detect such deviations between nominal and actual position, a sensor S5 may be configured along the excursion of the expelling element 8-1 or 8-2 or along an element ganged to them, preferably the drive plunger 12, a distance away from its end positions and at a position P5, said sensor S5 transmitting a signal to the pump control unit 68 when the pertinent element, in the preferred implementation the drive plunger 12, is in the position P5 of the monitoring sensor S5. By comparing the time of the monitoring signal from the monitoring sensor S5 with the time of the control signal reversing the direction of motion of the drive plunger 12, the pump drive control unit 68 is able to calculate whether the drive plunger 12 did reach the monitoring sensor S5 within a predetermined time interval (or at a predetermined speed) that is required for it to reach its final position in time. If there are deviations of a given value, the pump control unit 68 can then transmit an error (or warning) signal.

In addition to the monitoring sensor S5, FIG. 4 also shows a monitoring sensor S6 a distance away as seen in the direction of motion of the drive plunger 12 from the other monitoring sensor S5 and also a distance away from the two final positions of the drive plunger 12 and serving to generate a monitoring signal in the pump control unit 68 whenever the drive plunger 12 is situated opposite one of the two monitoring sensors S5 and S6. In this embodiment of the invention, the pump control unit 68—by comparing the time difference between the generations of the two monitoring signals of the two monitoring sensors S5 and S6 with a nominal time interval—is able to determine whether expelling elements 8-1, 8-2 did reach their particular final positions each within the cycle time. Even in this embodiment mode, the time difference allows calculating the speed of the drive plunger 12 or of the expelling elements 4-1, 4-2 by the pump control unit to be compared with a nominal speed. If there are given values of deviations between the nominal and actual time or between the nominal and actual speeds and hence also between the predetermined final position and the final position actually reached by the drive plunger 12 at its reversal of motion, the pump control unit 68 may to generate an error signal.

The error signal may be used for a number of purposes, for instance an optical and/or acoustic error display or to store the error value in a computer for diagnostic purposes.

In another embodiment mode of the present invention, the error signal may be used to so drive the reversing valve 30—as a function of the difference between nominal time (or speed) and actual time (or speed) of the drive plunger 12, that the changed speed of the drive plunger 12 will be compensated by a change in its stroke frequency, as a result of which the volumetric powder conveyance of the pump system shall remain constant within a predetermined tolerance range.

The design shown in FIG. 4 is identical with that of FIGS. 1 and 2 except that the pump control unit 68 contains the timer 80 and that the sensors S1, S2, S3 and S4 were replaced by the monitoring sensor S5 or by the two monitoring sensors S5 and S6. Identical components are denoted by the same reference symbol.

The embodiment modes of the invention described in relation to FIG. 4 also are applicable to other modes wherein, unlike the case for FIGS. 1, 2 and 4 showing membranes, instead pistons as in FIG. 3 are used as the expelling elements 8-1, 8-2, respectively.

According to preferred embodiment modes of the invention, the cycle time and/or the delay time may be variably adjustable. According to an especially preferred embodiment mode of the invention, in order to set a desired change in the quantity per unit time of conveyed quantity of powder, the cycle time is kept constant while the delay time is variable in order to adjust the desired quantity per unit time of conveyed powder. In this instance the delay time is that time interval by which powder conveyance out of the particular metering chamber 4-1 or 4-2 shall be delayed after the particular cycle time has lapsed at which the expelling element 8-1 or 8-2, respectively, was switched from pressure to suction stroke.

FIGS. 5 through 8 show a further embodiment of the invention whereby the powder intake valves 38-1 and 38-2 and/or the powder outlet valves 42-1 and 42-2 are automatically operating one-way valves of the duck-bill type which are automatically opened in the direction of transmission by the pressure of the compressed gas and/or are automatically closed by their own material's resiliency. Such a one-way valve is denoted in FIGS. 5 through 8 by the reference 38/42. It consists of an integral body made of a resilient material such as rubber. It contains a cylindrical part 82 fitted at one end with a circular, outwardly radially projecting flange 84 and af the other end with a hose part 86 tapering like a duck bill.

Figure 5:
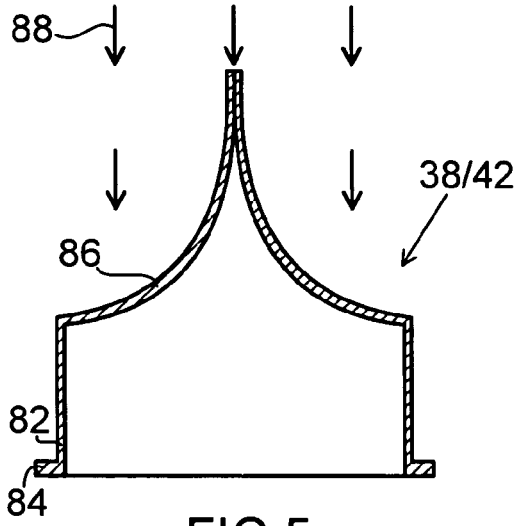
FIG. 5 is a longitudinal section of a one-way valve, a kind of duck-bill valve, in its closed position, said valve being applicable in all embodiments of pumping systems of the invention as a powder intake valve and/or as a powder outlet valve.
Figure 6:
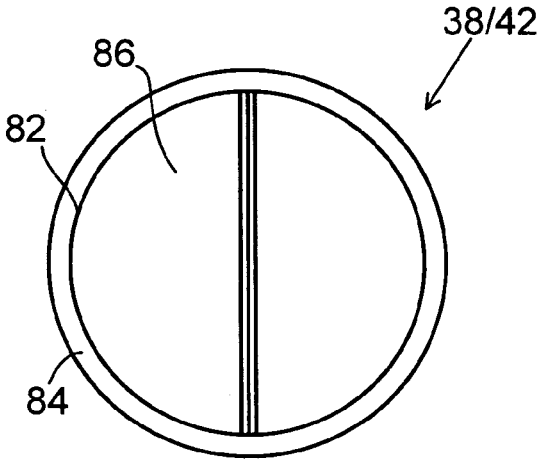
FIG. 6 shows the one-way valve of FIG. 5 in front view and toward the direction of conveyance.
Figure 8:
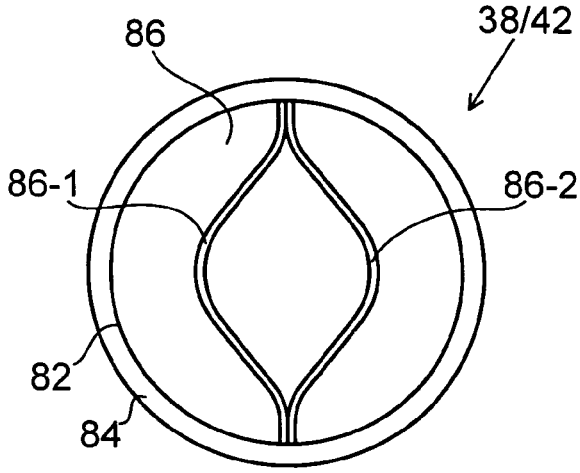
FIG. 8 is a front view opposite the direction of conveyance of the one—way valve of FIG. 7 in its open state.

If no pressure differential is present in both directions of flow on the one-way valve, then its own material resiliency will close it as shown by the longitudinal section of FIG. 5 and the front view of the valve tip of FIG. 6. The valve's closure force is reinforced when the compressed gas 88 acts in the direction of closure on the one-way valve as illustrated in FIG. 5.

When a compressed gas 90 is applied in the direction of transmission on the one-way valve 38-42, said gas forces apart the two duck bill parts 86-1 and 86-2 apart, and accordingly it opens the valve. This open position of the one-way valve is shown in longitudinal section in FIG. 7 and in front view opposite the direction of transmission in FIG. 8

Figure 7:
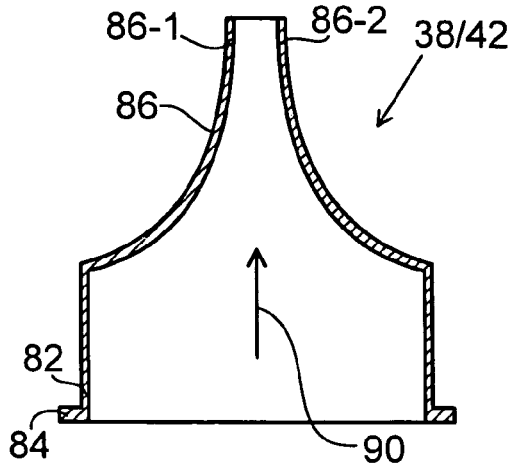
FIG. 7 shows the one-way valve in longitudinal section in its open state.
Figure 9:
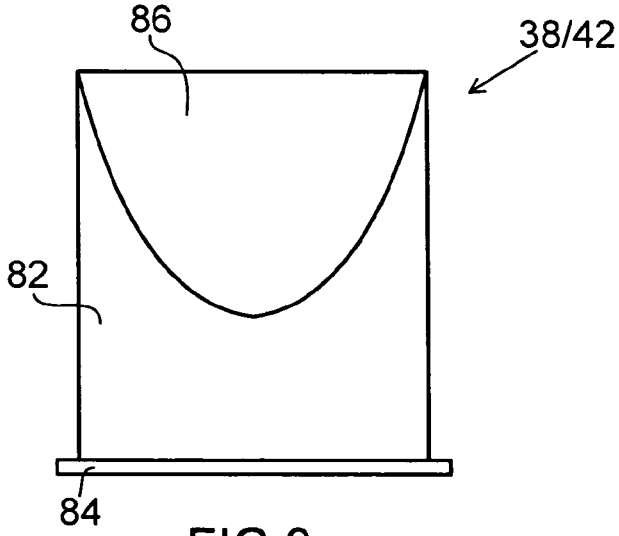
FIG. 9 shows the one-way valve of FIGS. 5 through 8 as a side view and rotated by 90° about the longitudinal axis relative to FIGS. 5 and 7.

FIG. 9 shows the one-way valve 38/42 in sideview and rotated by 90□ relative to FIGS. 5 and 7.

A waiting time may be designed into all embodiments of the invention for the motion reversal positions (dead points) of the expelling elements 8-1, 8-2, to allow the pump system to come to rest before the next stroke shall be carried out.

The specification, claims and drawings describe and show preferred embodiments of the invention without thereby limiting it. The invention does also include arbitrary combinations of at least two features of the specification, the claims and the drawings.

The invention claimed is:

1. A pumping system for coating powders, comprising at least one powder pump comprising:

a metering chamber which is bounded by a chamber housing; and an expelling element which is forward-displaceable relative to the chamber housing during a pressure stroke and backward during a suction stroke;

the metering chamber comprising:

a powder intake duct associated with a power intake valve, a powder outlet duct associated with a powder outlet valve, and a compressed gas intake duct associated with a compressed gas intake valve, the powder intake valve being opened to aspirate a metered quantity of powder into the metering chamber while the powder outlet valve and the compressed gas intake valve being closed, whereby a movement of the expelling element in the direction of the suction stroke aspirates powder through the powder intake duct into the metering chamber, and the powder intake valve being closed in order to convey the metered quantity of powder out of the metering chamber while the powder outlet valve and the compressed gas intake duct are opened, as a result of which compressed gas flowing from the compressed gas intake duct is able to force the metered quantity of powder from the metering chamber into the powder outlet duct;

said pump system further comprising a pump control unit to drive the compressed gas intake valve;

wherein the pump control unit comprises a time controller by means of which a predetermined delay time is counted since a predetermined operational point, the compressed gas being introduced at the end of the delay time into the metering chamber and the quantity of powdered metered until the end of the delay time is forced by the compressed gas out of the metering chamber.

2. The pump system as claimed in claim 1, further comprising a reversal device for reversing the motion of the expelling element from the suction stroke to the pressure stroke and vice-versa, wherein the pump control unit comprises a timer and transmits control signals, each upon the lapse of a predetermined cycle time counted by said timer, to the reversal device to reverse the motion of the expelling element from the suction stroke to the pressure stroke or vice-versa; and the pump control unit is configured to initiate at the time controller the predetermined delay time each time one of the control signals is generated to initiate the beginning of the suction stroke.

3. The pump system as claimed in claim 2, further comprising at least one monitoring sensor for detecting when the expelling element is at a predetermined position and generating a sensor signal upon detecting that the expelling element is in the predetermined position;

wherein the pump control unit is operationally connected to said at least one monitoring sensor, and is configured to automatically compare the time of the sensor signal with the time of at least one of the control signals to deduce whether a time interval between said two times deviates from a predetermined value, and to generate an error signal when the time interval does deviate from the predetermined value.

4. The pump system as claimed in claim 1, further comprising at least two monitoring sensors which are connected to the pump control unit to detect when the expelling element is situated in one of two different perdetermined positions, respectively, and to generate sensor signals when detecting the expelling elements in the predetermined positions, respectively;

wherein the pump control unit is configured to compare a time difference between the sensor signals from one of the monitoring sensors and the sensor signals from the other monitoring sensors on one hand and a predetermined time interval on the other hand, and to generate an error signal when the time difference deviates from the predetermined time interval by more than a predetermined value.

5. The pump system defined in claim 1, wherein the predetermined operational point corresponds to a predetermined suction stroke position of the expelling element during the suction stroke.

6. The pump system as claimed in claim 5, wherein the predetermined suction stroke position is a suction stroke initial position.

7. The pump system as claimed in claim 5, wherein the predetermined suction stroke position is situated between a suction stroke initial position and a suction stroke final position.

8. The pump system as claimed in claim 5, wherein the predetermined suction stroke position is situated between a suction stroke initial position and a suction stroke final position, nearer the former than the latter.

9. The pump system as claimed in claim 5, further comprising:

at least one sensor connected to the time controller to generate a sensor signal when the expelling element is situated in the predetermined suction stroke position.

10. The pump system as claimed in claim 5, further comprising:

a reversal device controlled by the pump control unit for reversing the motion of the expelling from the suction stroke to the pressure stroke and vice-versa; and two sensors coupled to said pump control unit, each said sensors generating a sensor signal when the expelling element is situated at one of two predetermined motion reversal positions, said sensor signal causing said pump control unit to control the reversal device to reverse the motion of the expelling element.

11. The pump system as claimed in claim 1, wherein the excursion of the expelling element is constantly the same size for all stroke displacements.

12. The pump system as claimed in claim 1, further comprising:

a reversal device controlled by the pump control unit for reversing the motion of the expelling element from the suction stroke to the pressure stroke and vice-versa;

wherein said pump control unit is configured to take a second delay time at least at one of the motion reversal positions of the expelling element before the expelling element having moved in one direction is moved by the reversal device in the opposite direction.

13. The pump system as claimed in claim 1, wherein the delay time is variably adjustable.

14. The pump system as claimed in claim 1, wherein the expelling element is a flexible membrane.

15. The pump system as claimed in claim 1, wherein the powder intake valve and the powder outlet valve are automatic values which are automatically opened and closed by the pressure differential across opposite sides of each said values.

16. The pump system as claimed in claim 15, wherein each of the powder intake and the powder outlet valve is a check valve comprising:

a valve seat; and a valve element which is displaceable as a function of said pressure differential relative to the value seat (38-4, 42-4) into an open or a closed position.

17. The pump system as claimed in claim 15, wherein each of the powder intake valve and the powder outlet valve includes a hollow valve element that automatically opens or closes on account of the pressure differential between the inside and the outside of the valve element.

18. The pump system as claimed in claim 1, comprising at least two said powder pumps;

wherein the powder intake ducts of the power pump are connectable to a powder source and the powder outlet ducts of the power pump are connectable to a common powder feed aperture; and said powder pumps are operable in tandem whereby a metered quantity of powder is expelled in alternating manner from the metering chamber of one powder pump is expelled or from the metering chamber of the other powder pump, by means of the compressed gas, into the respective powder outlet duct and reversely, powder is alternatingly aspirated through the powder intake ducts of said powder pumps into the respective metering chambers.

19. The pump system as claimed in claim 18, wherein the expelling elements of the pumps are actuated by a common drive.

20. A powder coating apparatus, comprising:

a powder spraying device for spraying coating powder onto an object to be coated; and a pump system as claimed in claim 1, to convey coating powder to said powder spraying device.

21. A method of conveying coating powder, said method comprising the steps of:

aspirating powder, by increasing the volume of a metering chamber, from a power source onto said metering chamber;

after said aspirating, expelling the metered quantity of powder, by means of compressed gas, out of the metering chamber, thereupon the volume of the metering chamber being decreased and the cycle of said aspirating and expelling steps being periodically repeated, wherein during said aspirating, a predetermined phase of the periodic change in volume of the metering chamber is detected; and said expelling is initiated with a predetermined delay time after the predetermined phase has been reached, whereby the quantity of powder metered up to that time is forced out of the metering chamber by means of the compressed gas.

22. The method as claimed in claim 21, further comprising:

using at least one valve in each of a powder intake duct into the metering chamber and a powder outlet duct out of the metering chamber, said valve automatically opening and closing as a function of the pressure difference between an upstream side and a downstream side of said at least one valve.

23. A method of conveying coating powder, said method comprising the steps of:

aspirating powder by enlarging the volume of at least one metering chamber from a powder source into the metering chamber; and after said aspirating, expelling the metered quantity of powder out of the metering chamber by compressed air, the volume of the metering chamber then being decreased and the cycle of said aspirating and expelling steps will be repeated periodically, wherein the volume changes of the at least one metering chamber are controlled by a predetermined cycle time, following lapse of the predetermined cycle time, at least one control signal is generated to reverse the direction of volume change from enlarging to decreasing or vice versa and, simultaneously, a predetermined delay time is initiated, and only when the predetermined delay time has lapsed shall the metered quantity of powder be forced by the component gas out of the metering chamber.

24. The method as claimed in claim 23, wherein the volume changes of the at least one metering chamber are implemented by an expelling element, the presence of the expelling element in a predetermined position is determined by at least one monitoring sensor and a monitoring signal is generated when the expelling element is detected in the predetermined position, and the time difference between the time of the monitoring signal and the time of the at least one control signal is compared with a predetermined time interval which is the time difference expected if the expelling element completes a predetermined excursion within each cycle time, and an error signal is generated when the gap between the time difference and the predetermined time interval exceeds a predetermined value.

25. The method as claimed in claim 23, wherein the volume changes of the at least one metering chamber are implemented by an expelling element, monitoring signals are generated by at least two monitoring sensors when the expelling element respectively assumes two predetermined end positions corresponding to a maximum and a minimum of said volume the time difference between the monitoring signals of one monitoring sensor and the monitoring signals of the other monitoring sensor is compared with a predetermined time interval which is the time difference expected if the expelling element completes a travel between said end positions within the cycle time, and an error signal is generated whenever the said time difference deviates by more than a predetermined value from the predetermined time interval.

26. The method as claimed in claim 21, comprising:

using, in tandem, two of the metering chambers that undergo volume changes simultaneously but at different phases, the volume of one metering chamber being enlarged while the volume of the other metering chamber is decreased, and vice-versa.

* * * * *